United States Patent [19]

Hoglund

[11] Patent Number: 4,617,762

[45] Date of Patent: Oct. 21, 1986

[54] CAM CONTROLLED MACHINE FOR FORMING NON-STANDARD SURFACES

[76] Inventor: Carl Hoglund, 58 Johnson Dr., Murray Hill, N.J. 07971

[21] Appl. No.: 514,512

[22] Filed: Jul. 18, 1983

[51] Int. Cl.[4] ..... B24B 17/02

[52] U.S. Cl. ..... 51/101 R; 51/90; 51/237 M; 51/DIG. 32; 409/142; 409/143; 384/490

[58] Field of Search ..... 51/90, 97 NC, 101 R, 51/105 EC, 217 R, 217 H, 236, 237 R, 240 R, 240 T, 240 A, DIG. 32, 237 M; 308/189 R; 409/142, 143; 418/61 H

[56] References Cited

U.S. PATENT DOCUMENTS

| | | | |
|---|---|---|---|
| 2,606,403 | 8/1952 | Musyl | 51/101 R X |
| 2,960,806 | 11/1960 | Kunzler | 51/237 R |
| 3,167,886 | 2/1965 | Harrison | 51/90 X |
| 3,650,936 | 3/1972 | Towle | 51/90 X |
| 3,663,188 | 5/1972 | Hoglund | 51/101 R |
| 3,800,621 | 4/1974 | Hoglund | 51/101 R X |
| 3,943,665 | 3/1976 | Nagashima | 51/DIG. 32 X |

FOREIGN PATENT DOCUMENTS

| | | | |
|---|---|---|---|
| 1577498 | 2/1970 | Fed. Rep. of Germany | 51/105 EC |
| 2718731 | 11/1977 | Fed. Rep. of Germany | 51/90 |

*Primary Examiner*—Robert P. Olszewski

*Attorney, Agent, or Firm*—Pennie & Edmonds

[57] ABSTRACT

A cam controlled grinding machine in one embodiment of which the spindle is supported for rotation and lateral movement within a nest of three annular rings. Advantageously, roller bearing arrays between the spindle and the first annular ring, the first and second annular ring, and the second and third annular ring permit the spindle and first and second annular rings to rotate relative to one another while the third annular ring is fixed in position. In order to permit lateral movement of the spindle, the centers of each roller bearing array are non-coincident. In a second embodiment the spindle is in effect mounted on an articulated arm having two degrees of freedom. As a result, the spindle can be moved laterally in two dimensions in response to movement imparted to it by the action of a drive follower and cam. In a third embodiment, an annular bearing plate is attached to the spindle and is supported for lateral movement by a plurality of balls contained underneath the bearing plate.

7 Claims, 9 Drawing Figures

FIG. 3
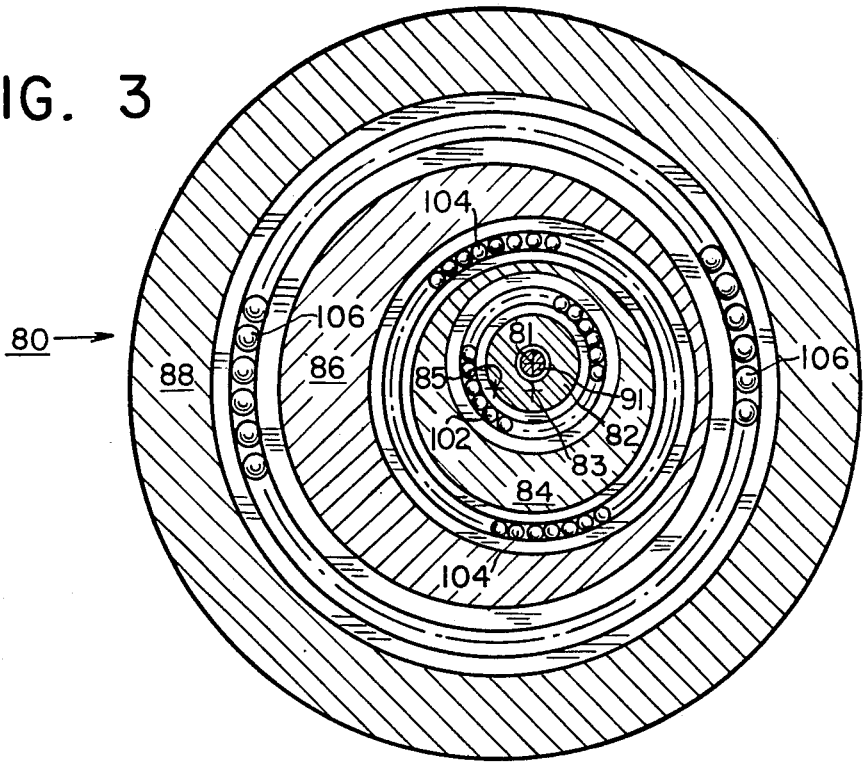
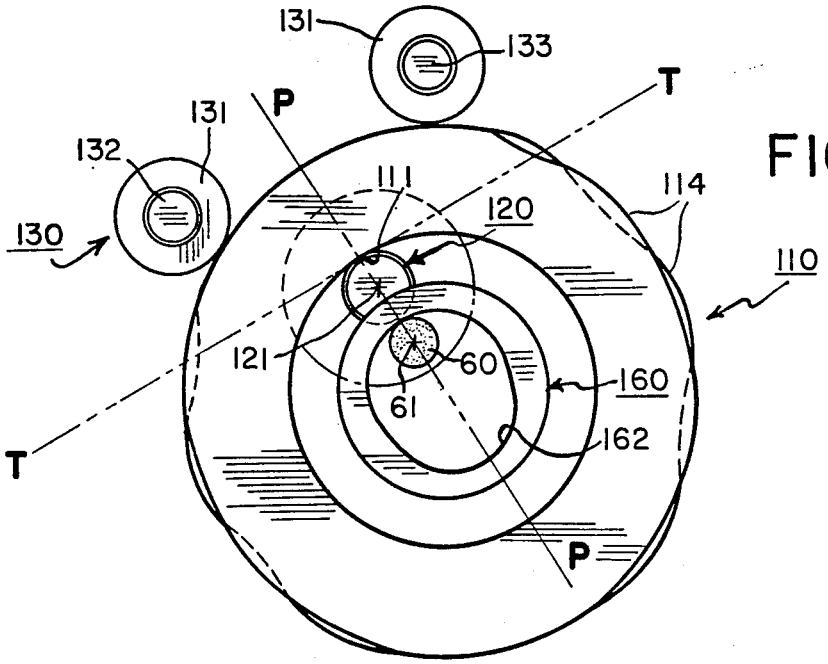
FIG. 4

CAM CONTROLLED MACHINE FOR FORMING NON-STANDARD SURFACES

CROSS-REFERENCE TO RELATED APPLICATION

A related application is "Worktable with Lateral and Rotational Movement", Ser. No. 514,505, filed simultaneously herewith and assigned to the same assignee.

BACKGROUND OF THE INVENTION

In manufacturing structural elements such as metal machine parts, it is often necessary that the element have a finished surface of particular design and shape. As an example, machine elements which are adapted to cooperate in a sliding, gearing or camming relation must have cooperating surfaces of precise shape. Where these surfaces are straight, circular, or of some other common shape, the machining or surfacing is not too difficult. Where, however, the desired surface of the element is a complicated curve, as for example, one having an ever changing radius of curvature, the machining thereof becomes both difficult and expensive.

If the desired surface is an external one, a lathe or similar cutting machine may be used. Also, where tolerances are not of critical importance, a milling machine may be used. A milling machine is advantageous in that it can mill both external and internal surfaces on a workpiece.

Where tolerances are critical, however, a grinding machine is usually employed. Grinding machines can produce extremely accurate surfaces; but when these surfaces are of unusual shape, the expense of constructing the machine to perform the particular grinding operation is often prohibitive. It may, for example, take a number of separate grinding operations to produce a particular complex surface with each of the grinding operations requiring that the workpiece be fed through a separate grinding machine. In addition, the feeding of the workpiece relative to the grinding wheel is difficult to control both with regard to its direction of movement and rate of feed past the grinding wheel. Different sized grinding wheels generally require that the workpiece be fed through different paths in order to produce the same surface. Similarly, as the grinding wheel becomes worn during a grinding operation, adjustments in the direction of movement of the workpiece must be made in order to maintain the desired surface cut. This is especially true where a curved surface is desired. In addition to the problems encountered with different sized grinding wheels, any changes in rate of feed of the workpiece relative to the grinding wheel adversely affects both efficiency of operation and the quality of the finished surface. Different grinding rates produce different surface finishes. This, in turn, necessitates further processing of the workpiece to obtain uniformity.

One solution to these requirements is the type of cam controlled grinding machine described in U.S. Pat. Nos. 3,663,188, 3,800,621 and 3,822,511 which are assigned to the present assignee. These patents are incorporated herein by reference. As disclosed, for example in FIGS. 1 and 2 of the '188 and '621 patents such devices include an annular cam member 1 having a surface 3 that is identical to a surface 9 of a workpiece 7 to be ground. The workpiece is fixed relative to the cam member so that as the cam member is moved the workpiece moves through a path corresponding to contoured surface 3 of the cam member; and a grinding wheel 8 engages the surface of the workpiece as it is fed along this path. To move the workpiece through the desired path, a rotating drive follower 2 engages contoured surface 3 of the cam member.

In accordance with the teachings of those inventions, cam member 1 is supported by being bolted to a support 22 that is attached to the lower end of a spindle 21. The upper end of the spindle has another support 23 to which workpiece 7 is attached for the grinding operation. The spindle is mounted within a housing 25 so that it is free to rotate about its longitudinal axis and is also free to move laterally during this rotation along a path dictated by the internal surface 3 of the cam member. For this purpose, the spindle includes a circular bearing plate 24 attached to the spindle intermediate its ends with the peripheral portion of the bearing plate disposed within housing 25. The housing includes a plurality of upper and lower pockets 26 and 27 facing the opposite sides of the bearing plate.

As disclosed in the '188 and '621 patents, pockets 26, 27 are supplied with air pressure to act against the opposed sides of the bearing plate in the housing 25. The sizes of the upper and lower pockets can be dimensioned and/or the air pressure regulated to compensate for the weight of the spindle and attached structure to cause the bearing plate to float within housing 25. Alternatively, hydraulic pressure may be provided; or air pressure may be supplied against the underside of the bearing plate while oil is provided for maintaining a sliding relationship of the upper side of the plate with the opposed wall of the housing. With either type of construction, a thrust bearing effect is produced which permits rotation of the spindle and lateral movement in a plane perpendicular to its axis of rotation with a minimum amount of friction.

SUMMARY OF THE INVENTION

While apparatus of the type described in the '188 and '621 patents performs satisfactorily in numerous applications, the use of pneumatic and/or hydraulic means to support spindle 21 results in a relatively complicated piece of equipment and one that requires substantial maintenance. In order to simplify the spindle support and reduce the maintenance required thereon, I have devised a means for supporting the spindle without the use of pneumatic or hydraulic systems. In one embodiment of my invention, the spindle is supported for rotation and lateral movement within a nest of three annular rings. Advantageously, roller bearing arrays between the spindle and the first annular ring, the first and second annular ring, and the second and third annular ring permit the spindle and first and second annular rings to rotate relative to one another while the third annular ring is fixed in position. In order to permit lateral movement of the spindle, the centers of each roller bearing array are non-coincident. As a result, the thickness of the first and second annular rings varies smoothly throughout the arc of the ring.

In a second embodiment the spindle is in effect mounted on an articulated arm having two degrees of freedom. As a result, the spindle can be moved laterally in two dimensions in response to movement imparted to it by the action of a drive follower and cam.

In a third embodiment, an annular bearing plate is attached to a rotatable spindle and is supported for lateral movement by a plurality of balls contained underneath the bearing plate.

BRIEF DESCRIPTION OF THE DRAWINGS

These and other objects, features and advantages of the invention will be more readily apparent from the following detailed description of the preferred embodiments of the invention in which:

FIG. 3 is a cross-sectional view of the support means 80 taken along lines 3—3 of FIG. 1;

FIG. 4 is a schematic illustration depicting the relation of certain elements of the embodiment of FIGS. 1 and 2;

DETAILED DESCRIPTION OF PREFERRED EMBODIMENTS OF THE INVENTION

Figure 1:
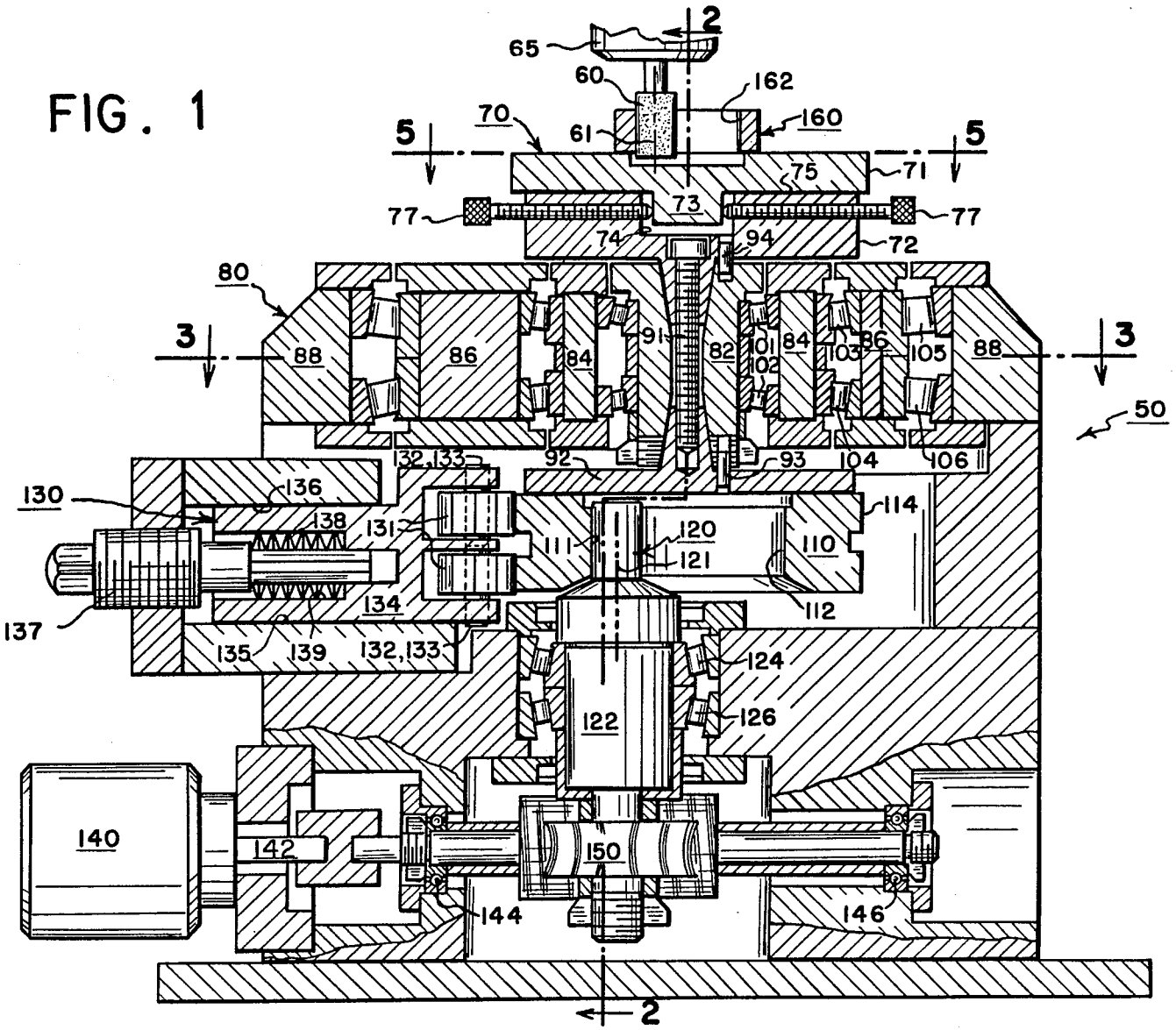
FIG. 1 is a cross-sectional view of a first illustrative embodiment of the invention.

As shown in FIGS. 1–4, a first illustrative apparatus 50 that embodies the invention comprises a grinding wheel 60, a grinding wheel drive motor 65, a worktable 70, a support means 80, an annular cam member 110, a cam drive follower 120, a cam guide follower 130, a drive motor 140, and coupling means 150 for connecting drive motor 140 to cam drive follower 120. Illustratively, cam drive follower 120 is mounted on a spindle 122 that is supported for rotation about axis 121 by upper and lower roller bearing arrays 124, 126. Illustratively, coupling means 150 is a worm gear that is driven by an output shaft 142 from motor 140. As shown in FIG. 1, shaft 142 is mounted in ball bearing arrays 144, 146.

Cam drive follower 120 engages an inner surface 112 of cam member 110 at point 111 and cam guide follower means 130 engages an outer surface 114 of the cam member to urge the inner surface into contact with follower 120. Advantageously, outer surface 114 is formed in two tracks of different contour as shown in FIG. 4; and cam guide follower means 130 is a pair of rotatable wheels 131 each of which engages one of these tracks. The wheels are mounted on axles 132, 133 in a frame member 134 that is slidably mounted between surfaces 135, 136 within a recess in grinding apparatus 50. The pressure of the cam guide follower means 132 on surface 114 can be adjusted by means of a threaded screw and shaft 137 that bear on a spring 138 within a recess 139 in frame 134.

Figure 2:
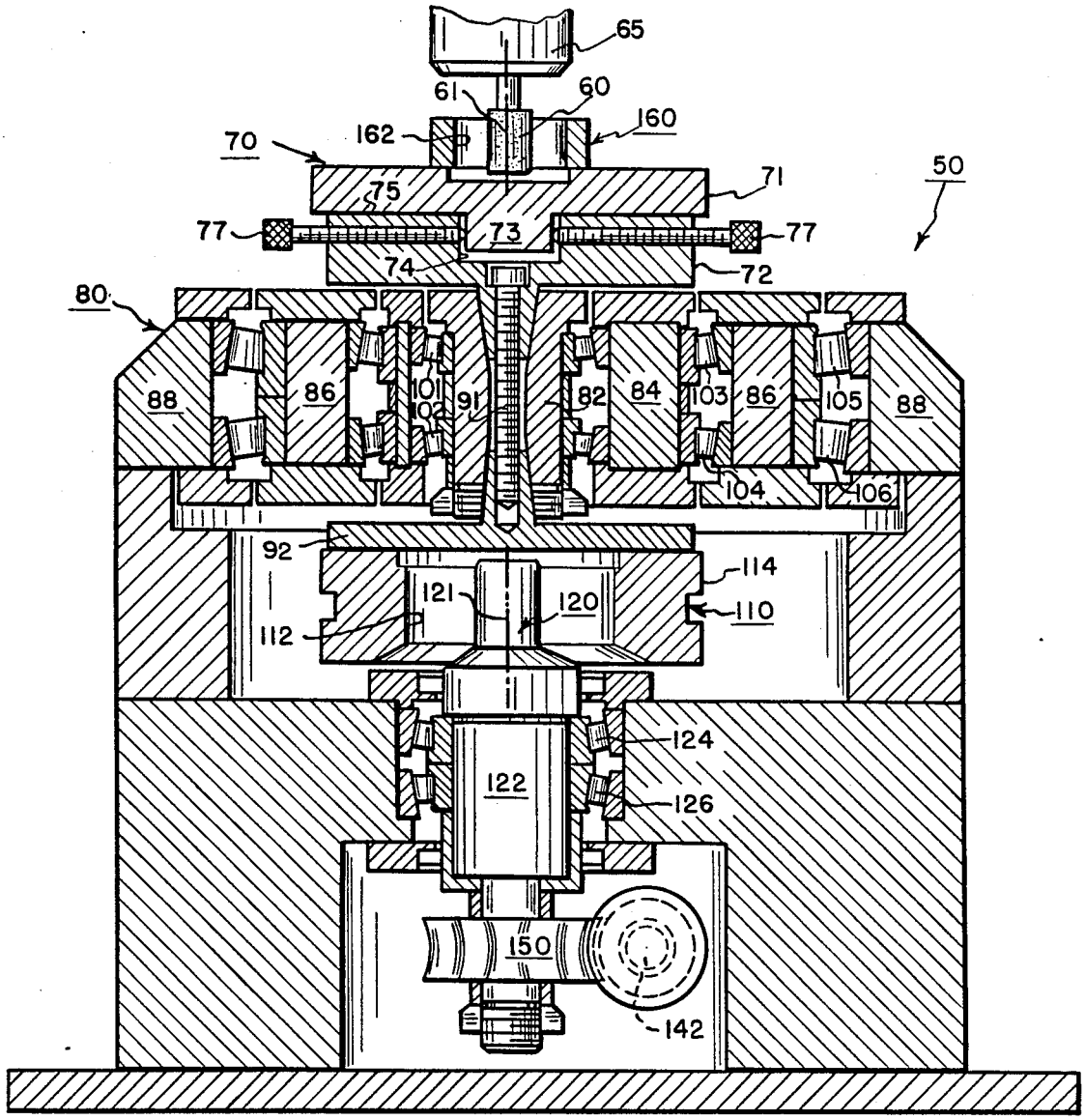
FIG. 2 is a cross-sectional view of the embodiment of FIG. 1 along line 2—2.

A similar cam 1, cam drive follower 2 and cam guide follower means 4 are described in detail in U.S. Pat. No. 3,663,188 at columns 3 and 4. As indicated in FIG. 2 of that patent, drive follower 2 and internal surface 3 of the cam are tangent to each other at contact point 11; and a plane P-1 extends through the axis of rotation of drive follower 2 and normal to the surface of the cam at point 11. The axis of rotation of grinding wheel 8 of the '188 patent is likewise located in plane P-1 but is movable therein toward workpiece 9. Similarly, as shown in FIG. 4 of the present specification, internal surface 112 of cam 110 is tangent to drive follower 120 at contact point 111 and a plane P extends through the axis of rotation 121 of drive follower 120 and normal to the surface of the cam. As described in the '188 patent at Col. 4, lines 22 through 43, guide follower means 4 holds cam 1 relative to drive follower 2 so that point 11 remains fixed and the tangent T to the internal surface of the cam at point 11 is always perpendicular to plane P-1. In like fashion, guide follower means 130 of the present specification holds cam 110 relative to drive follower 120 so that point 111 remains fixed and the tangent T to the internal surface of the cam at point 111 is always perpendicular to plane P. If the internal surface of the cam were a cylindrical section, the motion of the cam would be a simple rotation about the axis of the cylinder. Where the surface is non-cylindrical, however, the motion of the cam includes both rotational and lateral movement as the cam moves past the cam drive follower. The present invention is directed to means for providing for such rotational and lateral movement.

A workpiece 160 is mounted on worktable 70 and rigidly secured thereto by clamping means (not shown). In the example shown in FIGS. 1 and 2, an interior surface 162 of the workpiece is being ground by grinding wheel 60 which is driven by motor 65 about an axis of rotation 61. As shown in FIG. 4, axis of rotation 61 lies in plane P that extends through axis of rotation 121 of cam drive follower 120 and point 111 and is perpendicular to the tangent to the internal surface of cam 110 at point 111. Grinding wheel 60 is advantageously mounted by means such as those shown in FIG. 5 of the '188 patent, so that it can be fed into the workpiece along the plane extending through the axis of rotation of the cam drive follower and the point of contact between the cam drive follower and the internal surface of the cam. As a result, the surface being ground will always be perpendicular to plane P. In addition, the grinding wheel advantageously can also be reciprocated vertically by means shown in FIG. 3 of the '188 patent.

Figure 5:
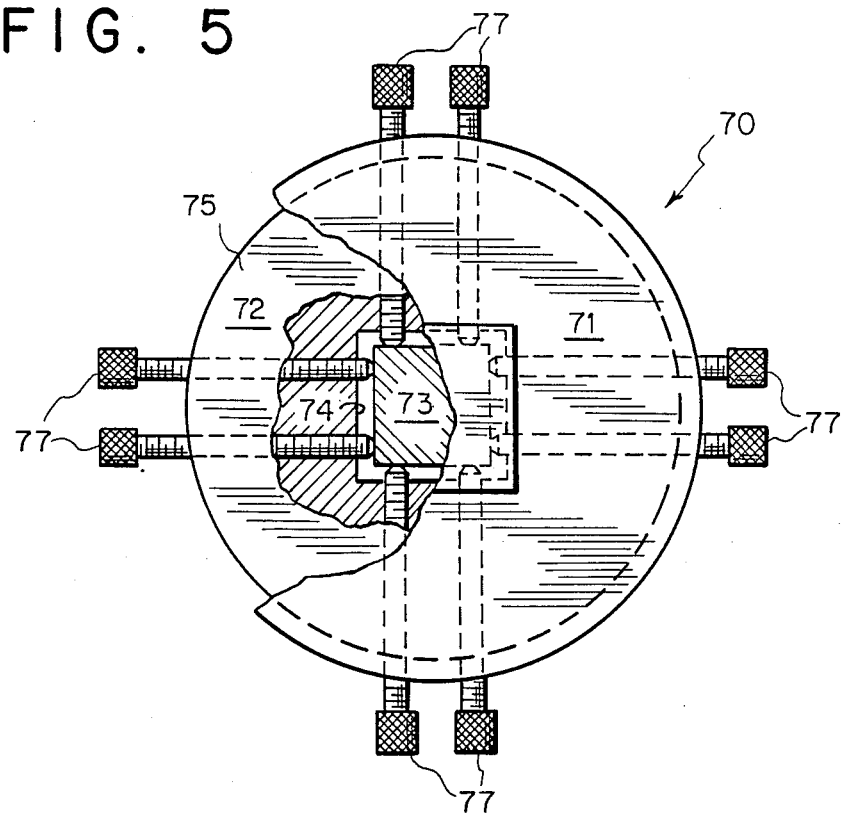
FIG. 5 is a partial cross-sectional view of a worktable 70 taken along lines 5—5 of FIG. 1.

As shown more clearly in FIG. 1 of the present specification, worktable 70 comprises upper and lower members 71, 72 that fit together in sliding relation with an extension 73 of the upper member protruding into a recess 74 in the lower member. Recess 74 is larger than extension 73 so as to permit upper member 71 to slide across the surface 75 between the upper and lower members. Adjustment screws 77 are mounted in lower member 72 so as to bear on extension 73 and thereby secure the upper member of worktable 70 in position relative to the lower member. By backing off on some screws while advancing others, the upper member of the worktable may be moved with respect to the lower member to adjust the position of the workpiece with respect to the grinding wheel. Advantageously, as shown in FIG. 5, extension 73 and recess 74 are square in shape and a pair of adjustment screws 77 bear on each surface of extension 73 in opposition to a pair of screws bearing on the opposite surface. The use of pairs of opposing adjustment screws has the advantage of permitting both rectilinear movement of upper member 71 depending on the amount of advancement of each pair of screws and rotational movement when the screws in each pair are advanced by different amounts.

In accordance with the invention, worktable 70 is supported for rotation by support means 80 that comprises a spindle 82 and three annular rings 84, 86, 88. Spindle 82 is rigidly connected to lower member 72 of worktable 70 and to cam member 110 by means of a threaded screw 91 and support plate 92. Worktable member 72 and support plate 92 are locked by pins 93, 94 to maintain a constant orientation relative to one another. Annular ring 88 is rigidly connected to the frame of apparatus 50. Support means 80 further comprises three pairs of upper and lower roller bearing arrays 101, 102, 103, 104, 105, 106 which are disposed between spindle 82 and annular rings 84, 86, 88. As shown in the top plan view of FIG. 3, each roller bearing array is circular but the centers of the three circles defined by the three upper and lower pairs of arrays are not coincident. In particular, the center of arrays 101, 102 and the axis of rotation of spindle 82 is axis 81, the center of arrays 103, 104 and the axis of rotation of annular ring 84 is axis 83, and the center of arrays 105, 106 and the axis of rotation of annular ring 86 is axis 85. As a result, each annular ring 84 and 86 has a variable thickness that changes smoothly from a minimum to a maximum and back to a minimum in 360° of arc of the annulus.

Spindle 82 rotates within the three nested sets of roller bearing arrays in accordance with the movement imparted to cam member 110 by cam drive follower 120. In addition, because the centers of the three upper and lower pairs of roller bearing arrays are not coincident, the position of the spindle and therefore of the workpiece varies laterally in two dimensions, again in response to the movement imparted to the cam member by the cam drive follower.

Figure 6:
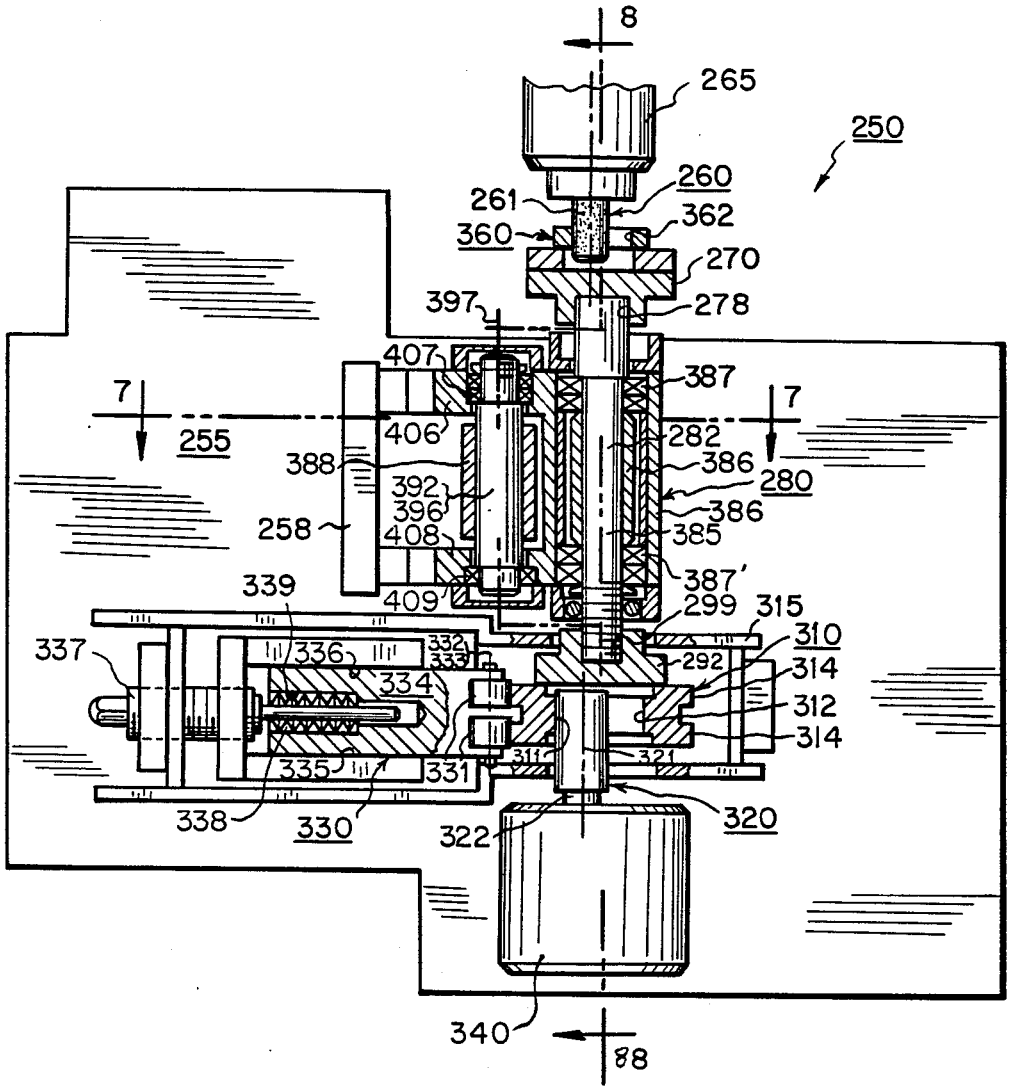
FIG. 6 is a cross-sectional view of a second illustrative embodiment of the invention.
Figure 7:
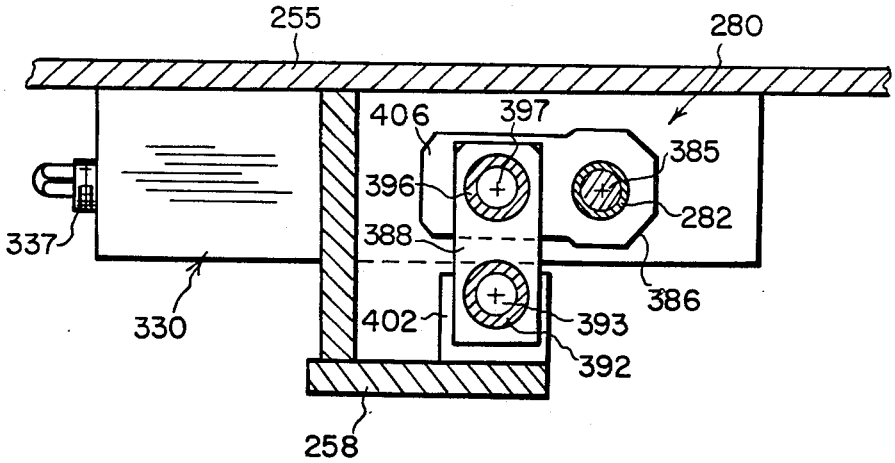
FIG. 7 is a top plan view of the second embodiment of the invention taken along lines 7—7 of FIG. 6.
Figure 8:
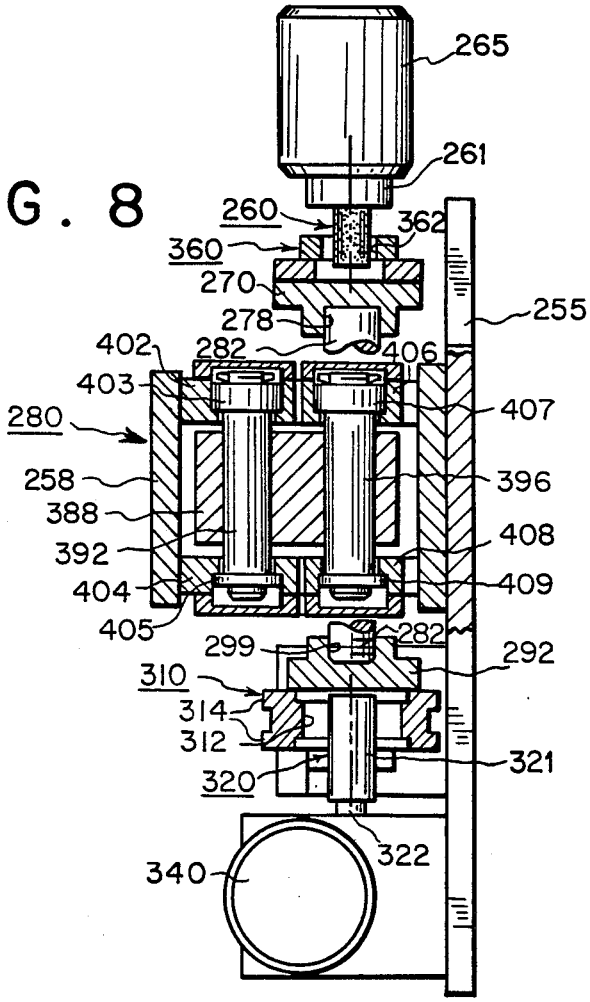
FIG. 8 is a cross-sectional view of the embodiment of FIG. 6 taken along lines 8—8 of FIG. 6.

As shown in FIGS. 6–8, a second illustrative apparatus 250 that embodies the invention comprises a grinding wheel 260, a grinding wheel drive motor 265, a worktable 270, a support means 280, an annular-cam member 310, a cam drive follower 320, a cam guide follower 330, and a drive motor 340. As will be apparent, these elements of FIGS. 6–8 have similar functions to the elements of FIGS. 1, 2 and 4 and are identified by the same numbers incremented by 200. The elements of FIGS. 6–8 are supported by a support plate 255. As shown in these Figures, motor 340 and a housing 315 for cam member 310, cam drive follower 320 and cam guide follower 330 are mounted directly on plate 255. As best shown in FIG. 7, support means 280 is mounted on plate 255 by an L-shaped member 258. Finally, grinding wheel drive motor is mounted by means (not shown) so that the position of the grinding wheel can be controlled relative to the position of the cam and cam drive follower.

Cam drive follower 320 and cam guide follower 330 are similar to cam drive follower 120 and cam guide follower 130 of FIGS. 1, 2 and 4 and operate in the same fashion to produce both rotational and lateral movement of the cam as the cam moves past the cam drive follower. Illustratively, cam drive follower 320 is mounted on a spindle 322 that is supported for rotation by motor 340 about axis 321. Cam drive follower 320 engages an inner surface 312 of cam member 310 at point 311 and cam guide follower means 330 engages an outer surface 314 of the cam member to urge the inner surface into contact with follower 320. Advantageously, outer surface 314 is formed in two tracks of different contour such as those shown in FIG. 4; and cam guide follower means 330 is a pair of rotatable wheels 331 similar to wheels 131, each of which engages one of these tracks. The wheels are mounted on axles 332, 333 in a frame member 334 that is slidably mounted between surfaces 335, 336 within a recess in grinding apparatus 250. The pressure of the cam guide follower means 330 on surface 314 can be adjusted by means of a threaded screw and shaft 337 that bear on a spring 338 within a recess 339 in frame 334.

A workpiece 360 is mounted on worktable 270 and rigidly secured thereto by clamping means (not shown). In the example shown in FIGS. 6 and 8, an interior surface 362 of the workpiece is being ground by grinding wheel 260 which is driven by motor 265 about an axis of rotation 261. As in the example shown in FIG. 4, motor 265 is mounted so that the axis of rotation 261 lies in a plane that extends through the axis of rotation 321 of cam drive follower 320 and point 311 and is perpendicular to the tangent to the internal surface of cam 310 at point 311. The grinding wheel is advantageously mounted by means such as those shown in FIG. 5 of the '188 patent so that it can be fed into the workpiece along the plane extending through the axis of rotation of the cam drive follower and the point of contact between the cam drive follower and the internal surface of the cam. In addition, the grinding wheel advantageously can also be reciprocated vertically by means shown in FIG. 3 of the '188 patent.

In accordance with the invention, workable 270 is supported for rotation and for lateral movement by support means 280. Support means 280 comprises a rotatable spindle 282 and a spindle housing 386 shown in FIGS. 6 and 7 and a horizontal support member 388, two pivoting shafts 392, 396 and two pairs of upper and lower shaft housings 402, 404, 406, 408.

Spindle 282 is mounted in housing 386 in two pairs of upper and lower ball bearing arrays 387, 387' so that the spindle may rotate about its axis 385. One end of spindle 282 is rigidly connected to a recess 278 in the bottom of worktable 270 and the other end to a recess 299 in a support plate 292. Support plate 292 in turn is rigidly connected to cam member 310 so as to move the spindle and worktable in accordance with the movement of the cam member past the cam drive follower.

Shafts 392, 396 are rigidly coupled together by horizontal support member 388 which as shown in FIGS. 6 and 8 contacts the shafts in their midportions. The end portions of both shafts are mounted for rotation within the upper and lower shaft housings. In particular, housings 402, 404 include ball bearing arrays 403, 405 that permit shaft 392 to rotate freely within the housing about shaft axis 393; and housings 406, 408 include ball bearing arrays 407, 409 that permit shaft 396 to rotate freely within the housings about shaft axis 397.

Upper and lower shaft housings 402, 404 are mounted on the end of L-shaped member 258 and thereby support horizontal support member 388 while also permitting its rotation about axis 393 of shaft 392. Upper and lower housings 406, 408 are mounted on shaft 396 and connected to spindle housing 386. As a result, spindle 282 and spindle housing 386 are supported by horizontal support member 388 and are able to rotate about axis 397 of shaft 396 and/or about axis 393 of shaft 392. In effect, spindle 292 is mounted on an articulated arm having two degrees of freedom.

The mounting of the workpiece on the spindle provides for rotation of the workpiece as the spindle is rotated in response to movement of the cam member. In addition, because the spindle and spindle housing may rotate about shaft axis 397 and because shaft 396 may rotate about shaft axis 393, the position of the spindle and therefore the position of the workpiece may also be varied laterally in two dimensions in response to the motion imparted to cam member 310 by cam drive follower 320.

Figure 9:
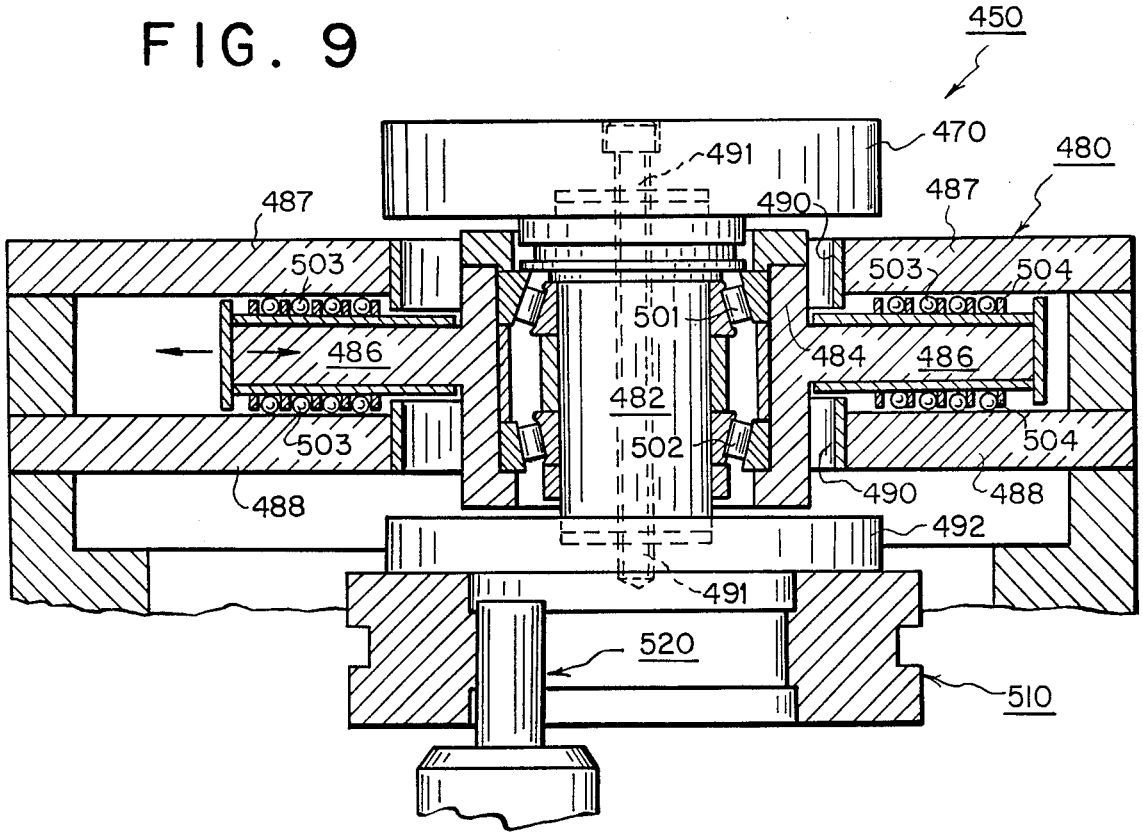
FIG. 9 is a cross-sectional view of a third embodiment of the invention.

A third illustrative embodiment of the invention is shown in partial view in FIG. 9. Apparatus 450 comprises a worktable 470, a support means 480, an annular cam member 510 and a cam drive follower 520. These elements have similar functions to the elements of FIGS. 1, 2 and 4 and are identified by the same numbers incremented by 400. Worktable 470 is supported for rotation by support means 480 that comprise a spindle 482, an annular ring 484 and a pair of upper and lower roller bearing arrays 501, 502. In addition, as shown in FIG. 9, support means 480 further comprises a disk-shaped support plate 486 that is attached to annular ring 484 and extends outwardly therefrom between upper and lower annular frame members 487, 488 in support means 480. The plane of the disk of support plate 486 is perpendicular to the axis of rotation of spindle 482. Support plate 486 is supported on frame member 488 by a plurality of ball bearings 503 contained within separator rings 504 mounted on the lower surface of plate 486. In addition, a like plurality of ball bearings 505 contained within separator rings 506 are mounted on the upper surface of plate 486 so as to engage upper frame member 487 and guide plate 486 in the recess defined between members 487 and 488.

Worktable 470 is supported in position by spindle 482, annular ring 484, support plate 486, ball bearings 503 within separator rings 504, and frame member 488. Spindle 482 is rigidly connected to worktable 470 on one end and to cam member 510 on the other end by a threaded screw 491 and a plate 492. Suitable locking means (not shown) may be provided to prevent rotation of the worktable or plate with respect to the spindle. The details of construction of cam member 510, and associated cam drive follower 520 and cam guide follower (not shown) are similar to those of cam member 110, cam drive follower 120 and cam guide follower 130 of FIGS. 1 and 2 and need not be discussed further.

As in the case of the embodiment of FIGS. 1–4, spindle 482 rotates within roller bearing arrays 501, 502 in accordance with the movement imparted to cam member 510 by cam drive follower 520. In addition, within the limits established by opening 490 in frame members 487, 488, annular ring 484 and support plate 486 are free to move laterally on ball bearings 503. As a result, the position of the spindle and therefore of the workpiece also varies laterally in two dimensions, again in response to the movement imparted to the cam member by the cam drive follower.

The foregoing describes several methods of providing for rotational movement as well as lateral movement in a cam controlled device. As will be apparent to those skilled in the art, numerous modifications may be made within the spirit and scope of the invention. For example, worktable 70 of FIG. 5 may be used in embodiments of FIGS. 6–8 and 9 as well as that of FIGS. 1–4. Various other mounting arrangements can be used to provide the rotational and lateral movement described. In the embodiment of FIGS. 6–8, for example, relative rotational movement of the pivoting shafts and their housing may be achieved by mounting shaft 392 on the end of L-shaped member 258 and connecting upper and lower housings 402, 404 to shaft 396, thus permitting shafts 402, 404 to rotate about shaft axis 393 and housings 406, 408 to rotate about shaft axis 397.

What is claimed is:

1. In a grinding machine comprising a grinding tool, a wortable on which a workpiece may be mounted for grinding, and a cam and a cam driver means for driving said worktable repeatedly through a path defined by said cam, apparatus for supporting said worktable comprising:

a spindle connected to said cam and said worktable, said spindle and the worktable connected thereto being moved repeatedly through said path by action of said cam and cam driver means, and first, second and third annular support means that are nested together with the spindle inside the first support means, the first support means inside the second and the second support means inside the third, said spindle and said first and second support means being mounted for rotation about a spindle axis, a first axis and a second axis of rotation, respectively, said spindle axis, first axis, and second axis being parallel to one another and spaced apart from each other, said first and second support means rotating with respect to each other about said first and second axes of rotation, respectively, as a result of translational motion imparted to said spindle by action of said cam and cam driver means.

2. The apparatus of claim 1 wherein the spindle axis, the first axis and the second axis of rotation are not collinear.

3. The apparatus of claim 1 further comprising bearing means mounted between said spindle and said first annular means, between said first and second annular means and between said second and said third annular means for permitting the rotation of the spindle and said first and second annular means.

4. The apparatus of claim 3 wherein the bearing means are roller bearings.

5. The apparatus of claim 3 wherein each bearing means is a circular array of roller bearings.

6. A grinding apparatus for grinding a surface of a workpiece comprising:

a cam member having a surface corresponding to the surface to be ground on the workpiece, a cam follower engaging the surface of the cam member, means for fixing the workpiece relative to said cam member, means for rotating said cam follower so as to cause relative movement of the cam surface with respect to the cam follower, means for supporting the workpiece and cam member for movement in accordance with the surface of said cam member, said means comprising:

a spindle connected to said cam member and said workpiece, said spindle and the workpiece connected thereto being rotated and translated by action of said cam member and cam follower, and first, second and third annular support means that are nested together with the spindle inside the first support means, the first support means inside the second and the second support means inside the third, said spindle and said first and second support means being mounted for rotation about a spindle axis, a first axis and a second axis of rotation, respectively, said spindle axis, first axis, and second axis being parallel to one another and spaced apart from each other, said first and second support means rotating with respect to each other about said first and second axes of rotation, respectively, as a result of translational motion imparted to said spindle by action of said cam member and cam follower, and grinding means for engaging the surface of the workpiece to be ground as the cam surface moves relative to the cam follower.

7. The apparatus of claim 6 further comprising bearing means mounted between said spindle and said first annular means, between said first and second annular means and between said second and said third annular means for permitting the rotation of the spindle and said first and second annular means.

* * * * *